US006634632B2

(12) United States Patent
Yaeger

(10) Patent No.: US 6,634,632 B2
(45) Date of Patent: Oct. 21, 2003

(54) VISE

(76) Inventor: William J. Yaeger, 2531 Beltview, Helena, MT (US) 59601

( * ) Notice: Subject to any disclaimer, the term of this patent is extended or adjusted under 35 U.S.C. 154(b) by 0 days.

(21) Appl. No.: 10/161,888

(22) Filed: Jun. 4, 2002

(65) Prior Publication Data

US 2002/0180134 A1 Dec. 5, 2002

Related U.S. Application Data

(60) Provisional application No. 60/296,207, filed on Jun. 4, 2001.

(51) Int. Cl.[7] ..... B25B 5/16

(52) U.S. Cl. ..... 269/283; 269/43; 269/277

(58) Field of Search ..... 269/283, 271, 269/277, 266, 43, 259, 258

(56) References Cited

U.S. PATENT DOCUMENTS 4,928,938 A * 5/1990 Ross ..... 269/261
5,419,540 A * 5/1995 Teafatiller ..... 269/261
5,595,378 A * 1/1997 Martinsson et al. ..... 269/210
5,906,365 A * 5/1999 Wu ..... 269/43

* cited by examiner

*Primary Examiner*—Lee D. Wilson

(57) ABSTRACT

The present invention allows a user to attach a pair of pliers to a vise for holding an article. The vise includes at least one set of two receptacles. Each receptacle is designed and placed in correlation to the other said receptacle to hold one handle of a standard pair of pliers. As the vise jaws are adjusted, the pliers' jaws are also adjusted, thereby allowing an individual to quickly, securely, and safely hold an article while working on that article with both hands.

2 Claims, 2 Drawing Sheets

VISE

CROSS REFERENCE TO RELATED APPLICATIONS

This application claims the benefit of a Provisional Patent Application, Application No. 60/296,207, filing date of Jun. 4, 2001.

BACKGROUND OF THE INVENTION

Often, when an individual wishes to work with a small or delicate article, the individual must hold the article in one hand while working on the article with the other. This obviously precludes working on the article with both hands. Usually, using both hands would make the work proceed in a more efficient and effective manner. In other words, often when working on a small or delicate article, the individual needs a "third hand".

There are products currently on the market that may act as a clamping device or other "third hand" attachment to a vise, but utilizing these attachments requires that you must then remove that attachment before using the vise in a standard fashion. Also, these attachments can be expensive, difficult to operate, and can be themselves delicate or fragile.

Patent searches using the terms "vise" and "attachment" and "vise" and "pliers" revealed nothing that resembled the disclosed invention. Therefore, there is no vise on the market, or for which a patent has been granted, that allows a user to quickly, securely, and safely hold a small or delicate article on a vise while at the same time allowing the individual to use the vise in a standard manner.

BRIEF SUMMARY OF THE INVENTION

The Yaeger Third Hand Vise overcomes the above-described problems by providing a vise that readily accepts a standard pair of pliers. The pliers then serve as the necessary "third hand" when working with small or delicate articles.

The Third Hand Vise operates as follows:

Each of the two vise jaws has at least one hole or receptacle;

Such receptacle is designed and placed in correlation to the other receptacle to accept one of the two handles of a standard pair of pliers;

As the distance between the vise jaws is adjusted, so the distance between the pliers jaws is adjusted; and When the individual no longer has a need for the pliers, the individual simply removes the pliers from the receptacles and proceeds to use the vise in a normal manner.

A typical use of the vise attachment may include:

Adjusting the distance between the vise jaws to allow the placement of a handle of a standard pair of pliers into a receptacle on each vise jaw;

Placing a standard pair of pliers into said receptacles;

Adjusting the vise jaws until the pliers jaws are the proper distance to hold the desired article.

The device will be of use to anyone who needs to hold a small or delicate article in place while working on that article with both hands.

DETAILED DESCRIPTION OF THE INVENTION

Figure 1:
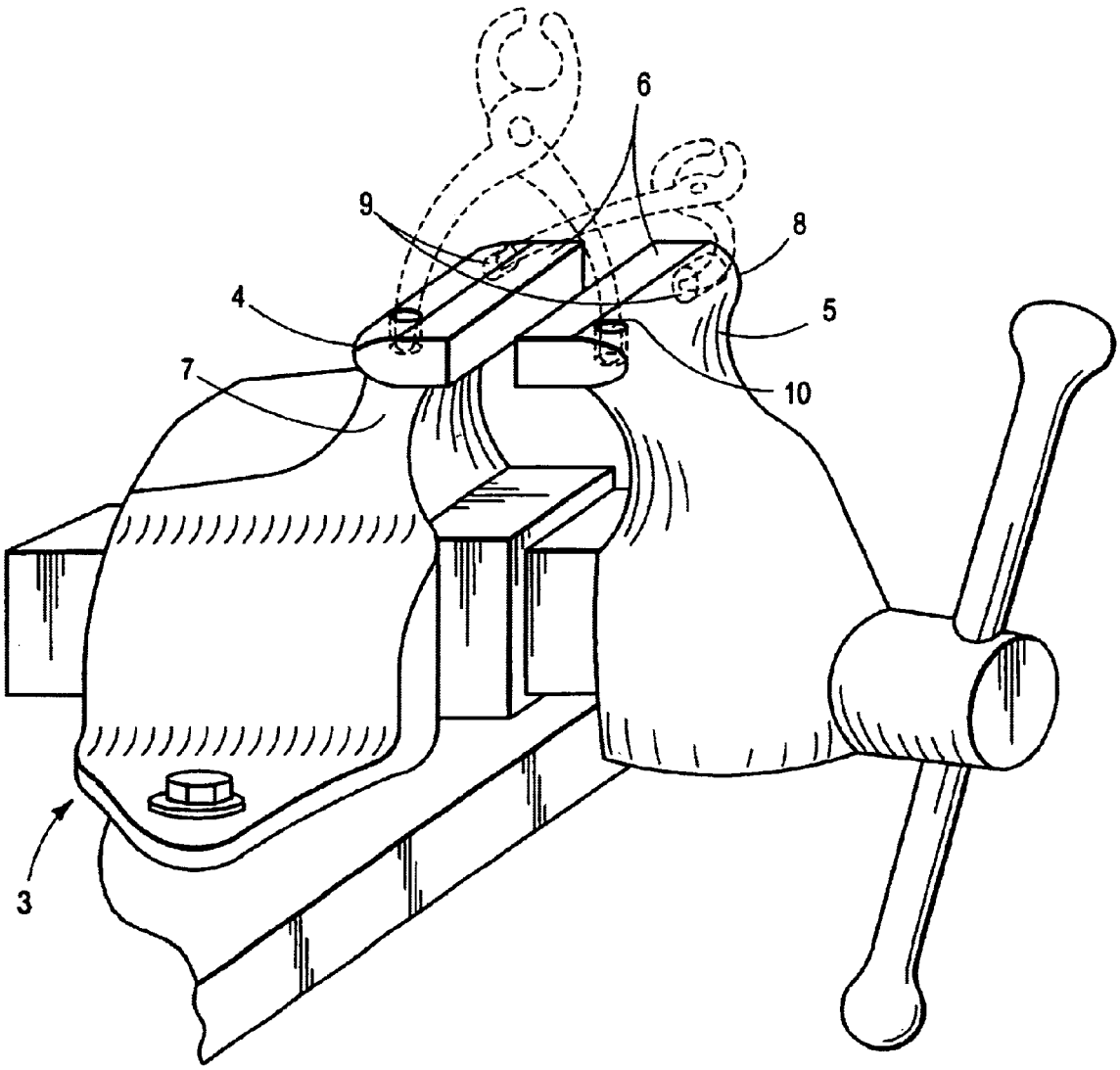
FIG. 1 shows a standard vise with a set of vertical receptacles (FIG. 1A) and a set of horizontal receptacles (FIG. 1B)

With reference now to FIG. 1, the preferred embodiment of the new Yaeger Vise comprises a plurality of components. In their broadest context, such components include:

a bench vise 3 including;

two jaws 4 and 5, the distance between each jaw being adjustable;

each said jaw having a top side 6 a left side 7 and a right side 8;

at least one set of two receptacles 9 and 10 each receptacle designed and placed in correlation to the other receptacle to accept one handle of a pair of standard pliers; and each receptacle being located in each one of two vise jaws.

Figure 2:
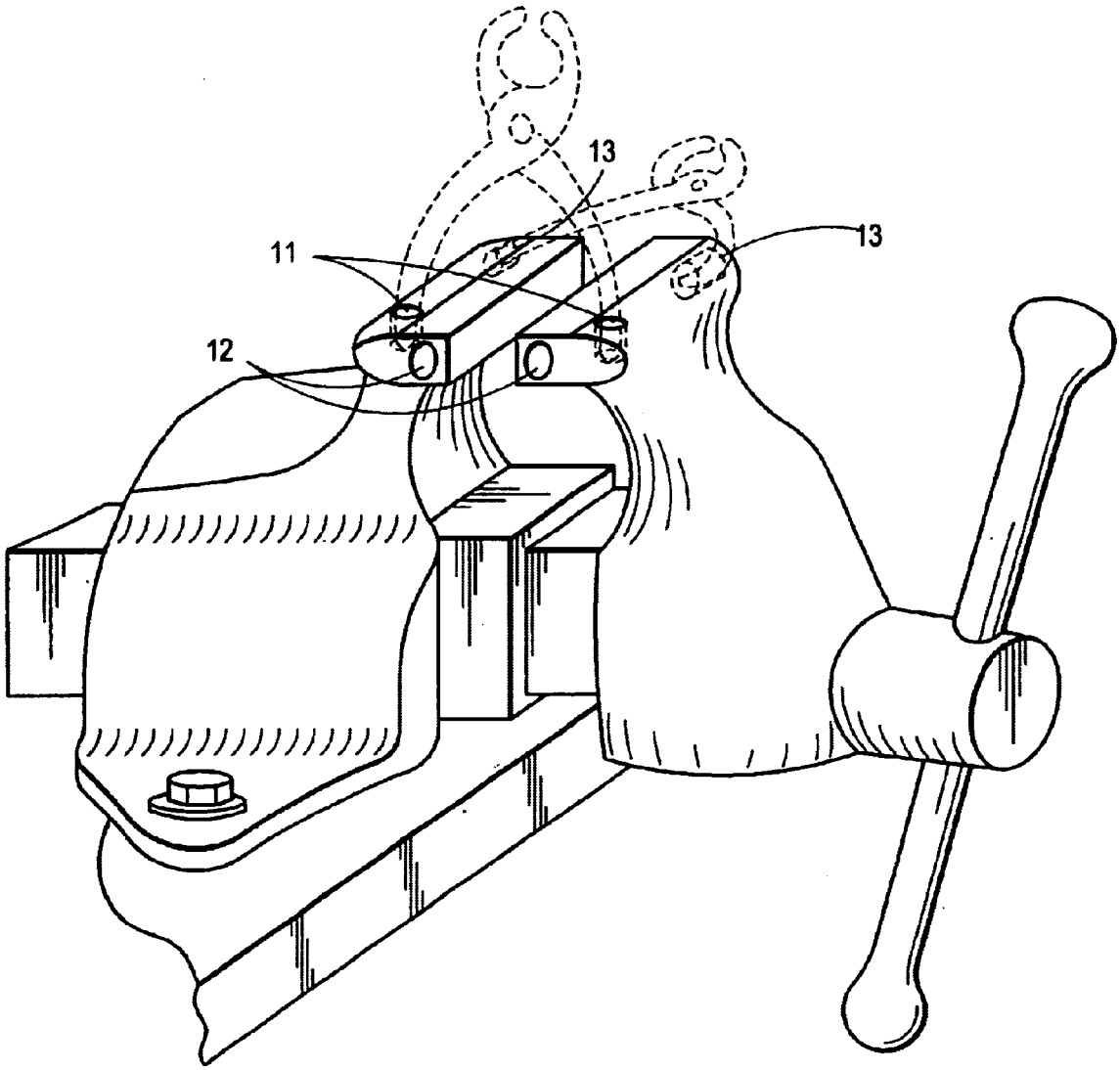

FIG. 2 shows a particular embodiment of the vice providing three sets of receptacles 11, 12, and 13 providing for a plurality of positions for the pair of pliers.

Such components are individually configured and correlated with respect to each other to provide a means for attaching a pair of pliers to a bench vise in such a manner that by adjusting the distance between the jaws of the vise also adjusts the distance between the jaws of the pliers. The receptacles may also be located in the vise jaws to allow for either vertical 11 or horizontal 12 attachment of the pliers to the vise.

I claim:

1. A vise that accepts a pair of pliers comprising:

two jaws, the distance between the jaws being adjustable;

at least one set of two receptacles, each said receptacle designed and placed in correlation to the other said receptacle to accept one handle of a pair of standard pliers; and each said receptacle is located in each one of said two vise jaws whereby the said pliers are held horizontally.

2. The vise claimed in claim 1 above where there are three sets of receptacles:

one said set of receptacles being located in each said vise jaw whereby one handle of said pliers is held vertically from the top side of each jaw;

one said set of receptacles being located in each said vise jaw whereby one handle of said pliers is held horizontally from the right side of each jaw;

one said set of receptacles being located in each said vise jaw whereby one handle if said pliers is held horizontally from the left side of each jaw.

* * * * *